US006090216A

United States Patent [19]

Yamaguchi et al.

[11] Patent Number: 6,090,216

[45] Date of Patent: Jul. 18, 2000

[54] CLEANING DEVICE AND CLEANING METHOD FOR APPLICATOR NOZZLE

[75] Inventors: Kazunobu Yamaguchi; Junji Kutsuzawa; Shigemi Fujiyama; Hiroyoshi Sago, all of Kanagawa, Japan

[73] Assignee: Tokyo Ohka Kogyo Co., Ltd., Kanagawa, Japan

[21] Appl. No.: 09/067,452

[22] Filed: Apr. 28, 1998

[30] Foreign Application Priority Data

May 1, 1997 [JP] Japan ..... 9-113866

[51] Int. Cl.[7] ..... B08B 9/00

[52] U.S. Cl. ..... 134/10; 134/22.1; 134/26; 134/166 R; 134/169 R; 239/112; 118/302

[58] Field of Search ..... 134/170, 169 R, 134/166 R, 102.1, 102.2, 102.3, 166 C, 169 C, 10, 21, 22.1, 22.11, 22.18, 26; 239/112; 118/302

[56] References Cited

U.S. PATENT DOCUMENTS

| | | |
|---|---|---|
| 4,204,977 | 5/1980 | Zwirlein . |
| 4,387,002 | 6/1983 | Knecht . |
| 4,416,213 | 11/1983 | Sakiya . |
| 4,528,996 | 7/1985 | Jonea . |
| 4,583,691 | 4/1986 | Smith . |
| 4,730,631 | 3/1988 | Schwartz . |
| 5,066,336 | 11/1991 | Hoffman et al. . |
| 5,089,305 | 2/1992 | Ushijima et al. . |
| 5,136,972 | 8/1992 | Naka et al. . |
| 5,183,508 | 2/1993 | Cholinski . |
| 5,186,194 | 2/1993 | Kitajima . |
| 5,275,658 | 1/1994 | Kimura . |
| 5,827,744 | 10/1998 | Fose et al. . |

FOREIGN PATENT DOCUMENTS

| | | |
|---|---|---|
| 9-29155 | 2/1997 | Japan . |
| 9-330876 | 12/1997 | Japan . |

*Primary Examiner*—Frankie L. Stinson
*Attorney, Agent, or Firm*—Merchant & Gould P.C.

[57] ABSTRACT

A cleaning device for cleaning a slit-like nozzle having an opening of a predetermined breadth for discharging liquid paint, with uniformity and with a small amount of cleaning liquid, wherein under a condition that a nozzle N is mounted on receiver plates 4, 4, a substantially air-tight space is formed, and a gas supply conduit is opened at one end of a cleaning portion 2 in the direction of the breadth of the nozzle, and an exhaust conduit 7 is opened at the other end thereof, being disposed in a vicinity of the gas supply conduit, so as to supply the cleaning liquid into the air-tight space. Then, since the air inside of the air-tight space is extracted from the exhaust conduit 7, the gas supplied from the one end flows towards the exhaust conduit 7 at the other end. The cleaning liquid contacts with the surface of the nozzle so as to dissolve and wash away any liquid paint adhering thereon.

5 Claims, 4 Drawing Sheets

CLEANING DEVICE AND CLEANING METHOD FOR APPLICATOR NOZZLE

BACKGROUND OF THE INVENTION

1. Field of the Invention

The present invention relates to a cleaning device and a cleaning method for cleaning or washing an applicator nozzle for applying liquid paint with a constant thickness upon a surface of plate-like materials to be processed, such as a semiconductor wafer or a glass substrate.

2. Description of Related Art

Conventionally, in order to apply resist liquids, etc., upon a surface of a plate-like material to be processed, such as a semiconductor wafer or a glass substrate, liquid paint is applied to a center of the material to be processed, which is mounted on a spinner, so as to be spread outwardly due to centrifugal force caused due to rotation thereof on a spinner. However, with this method, almost all of the liquid paint is scattered away and the quantity remaining upon the surface of the material is very little, and therefore this is a wasteful method.

As a result, in place of the method of applying liquid by use of a spinner described above, another method has been proposed, wherein an opening having a predetermined breadth is formed in the nozzle itself so as to discharge the liquid paint, and the liquid paint is applied with the predetermined breadth opening upon the surface of the material to be processed by moving the nozzle relative to the material.

By use of such a nozzle having a discharge opening for the liquid paint with the predetermined breadth as mentioned above, although wasting the liquid paint can be avoided and effective application thereof can be done, since the nozzle has a wide breadth, a large amount of the liquid paint accumulates in the periphery of the tip of the nozzle, thereby causing generation of a contaminating substance when it dries up. Therefore, the liquid paint attached to the tip of the nozzle and at the periphery thereof must be removed therefrom by washing or cleaning after the application procedure.

As a method of cleaning, the extraneous contaminating substance adhering to the tip of the nozzle can be removed by means of a roller on which cleaning liquid is present. However, it is impossible to supply a sufficient amount of the cleaning liquid on the surface of the roller, and therefore, the liquid paint adhering to the nozzle tip cannot be removed in a short time period. Further, since the cleaning liquid dissolving the extraneous substance therein is returned back to a reservoir for cleaning liquid, the cleaning liquid is easily polluted therewith.

SUMMARY OF THE INVENTION

The same applicant previously proposed a cleaning device in which a cleaning portion is formed, having a breadth which is nearly equal to that of the nozzle. In this cleaning device, a slit, which is coupled to a supply source of the cleaning liquid, and an exhaust aperture, which is coupled to a vacuum device, are formed on a side surface of the cleaning portion opposite to the side surface of the nozzle.

With this cleaning device, fresh cleaning liquid can be always supplied to the nozzle tip and washing of the nozzle tip can be achieved with uniformity and with good efficiency. However, so as to maintain the distance between the nozzle tip and the slit over a whole area in the breadth direction of the nozzle, the acceptable error for manufacturing the cleaning portion must be very small with respect to sizes thereof, thereby necessitating a great deal of time in manufacturing thereof.

For resolving such drawbacks in the conventional art mentioned in the above, in accordance with the present invention, there is provided a cleaning device for cleaning an applicator nozzle having an opening of a predetermined breadth for discharging a liquid paint, comprising: a cleaning portion being longer than the breadth of said nozzle and having an opened upper surface, wherein said cleaning portion defines a substantially air-tight space therein when said nozzle is mounted thereon; a gas supply conduit being opened at one end of said cleaning portion, in a direction of the breadth of said nozzle; a cleaning liquid supply conduit being disposed in a vicinity of said gas supply conduit; and an exhaust gas conduit being opened at the other end of said cleaning portion.

Further, a cleaning liquid reservoir portion may be formed separately from said cleaning portion, for the purpose of dipping the tip of said applicator nozzle in the cleaning liquid for a long time. With this, adhesion due to drying of the liquid paint which is attached at the nozzle tip can be prevented beforehand.

Further, the cleaning liquid reservoir portion may be formed at a bottom of said cleaning portion. With this construction, the substantially air-tight space of said cleaning portion is filled with the cleaning liquid, and therefore the liquid paint adhering at the nozzle tip will not remain adhered thereto through drying.

Moreover, a cleaning method for an applicator nozzle of the present invention relates to a cleaning method by use of the cleaning device mentioned in the above, wherein drying of said nozzle is effected by supplying only a gas after the completion of cleaning of said nozzle. Further, according to another cleaning method using this cleaning device, the method comprises the steps of: closing said gas supply conduit; and supplying only the cleaning liquid.

DESCRIPTION OF THE PREFERRED EMBODIMENTS

Figure 1:
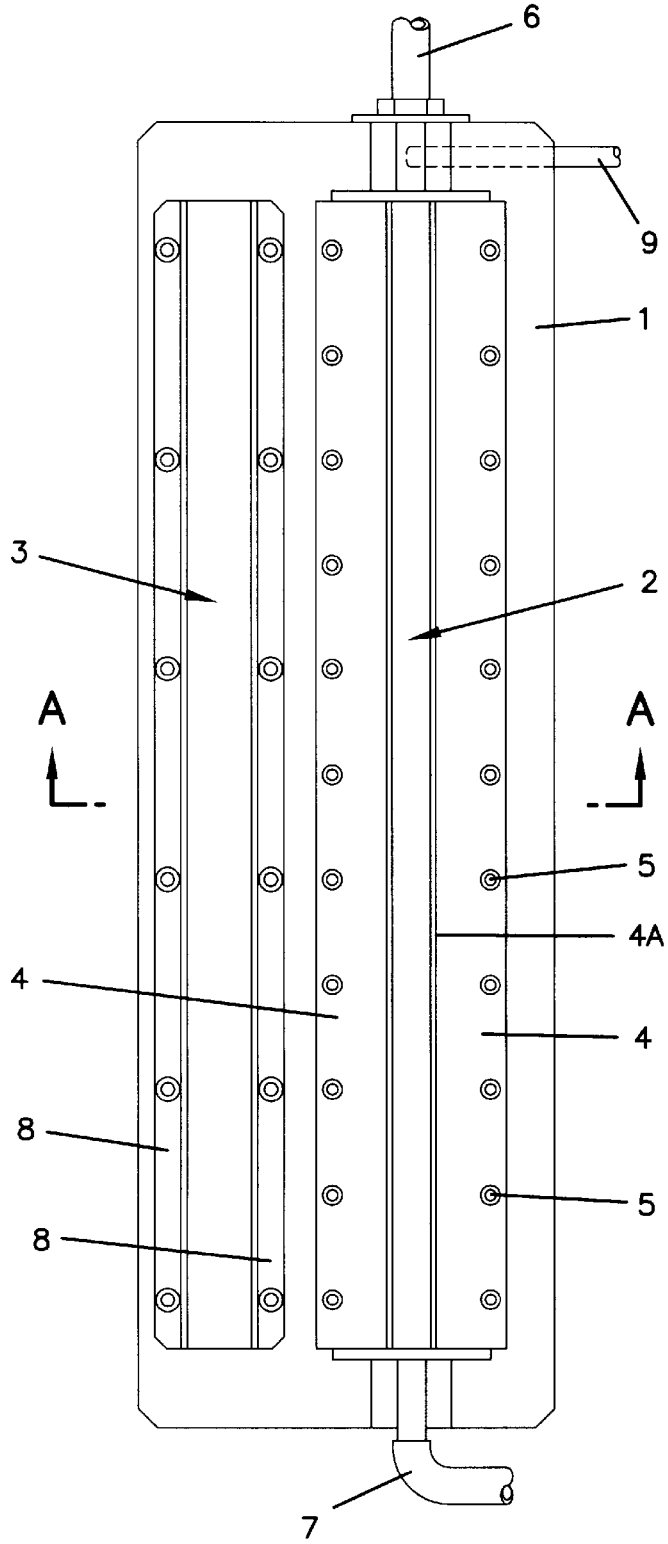
FIG. 1 is a plan view of showing a cleaning device in accordance with the present invention.
Figure 2:
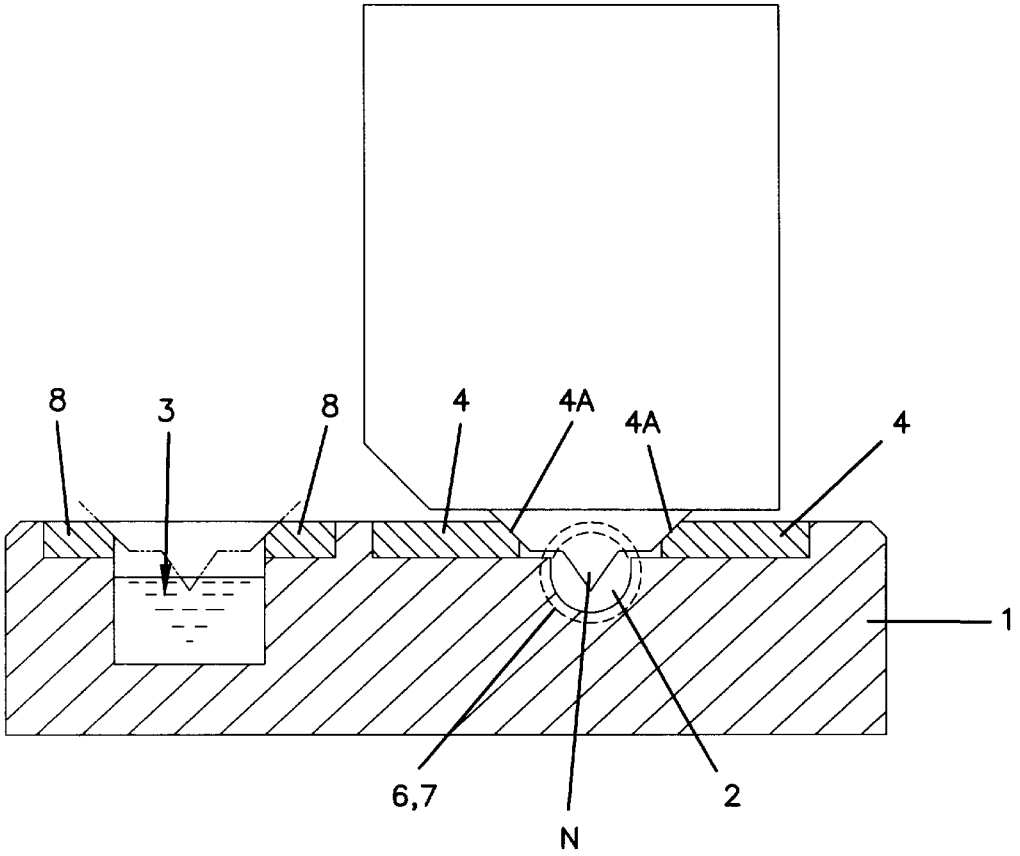
FIG. 2 is an enlarged cross-sectional view along a cutting line A—A in FIG. 1.
Figure 3:
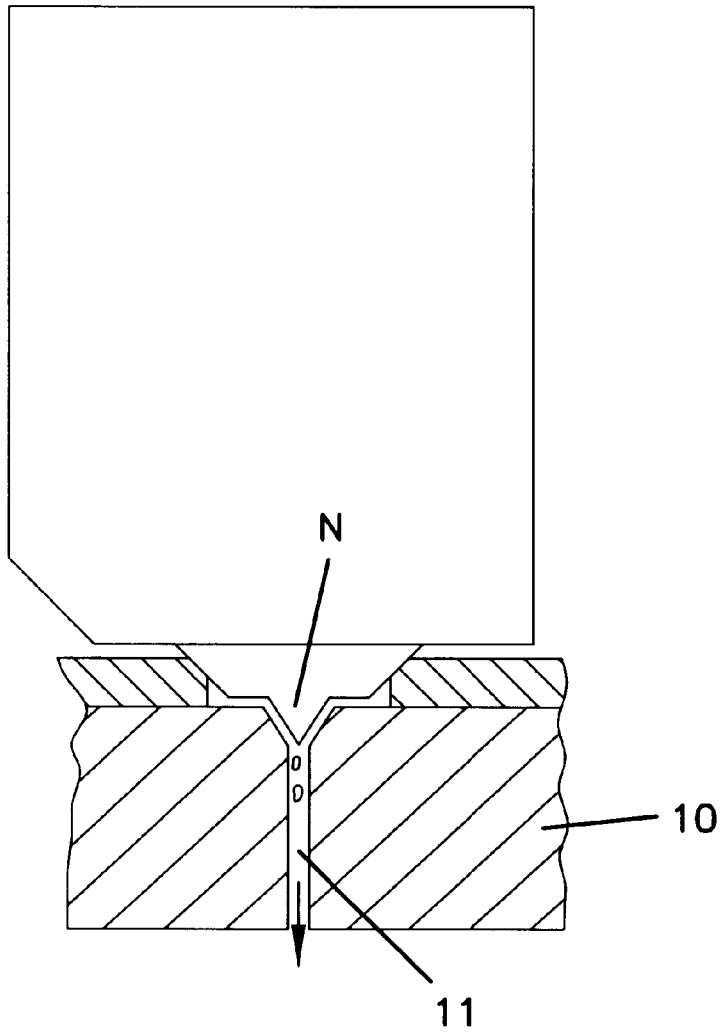
FIG. 3 is a cross-sectional view showing a predispenser stage.
Figure 4:
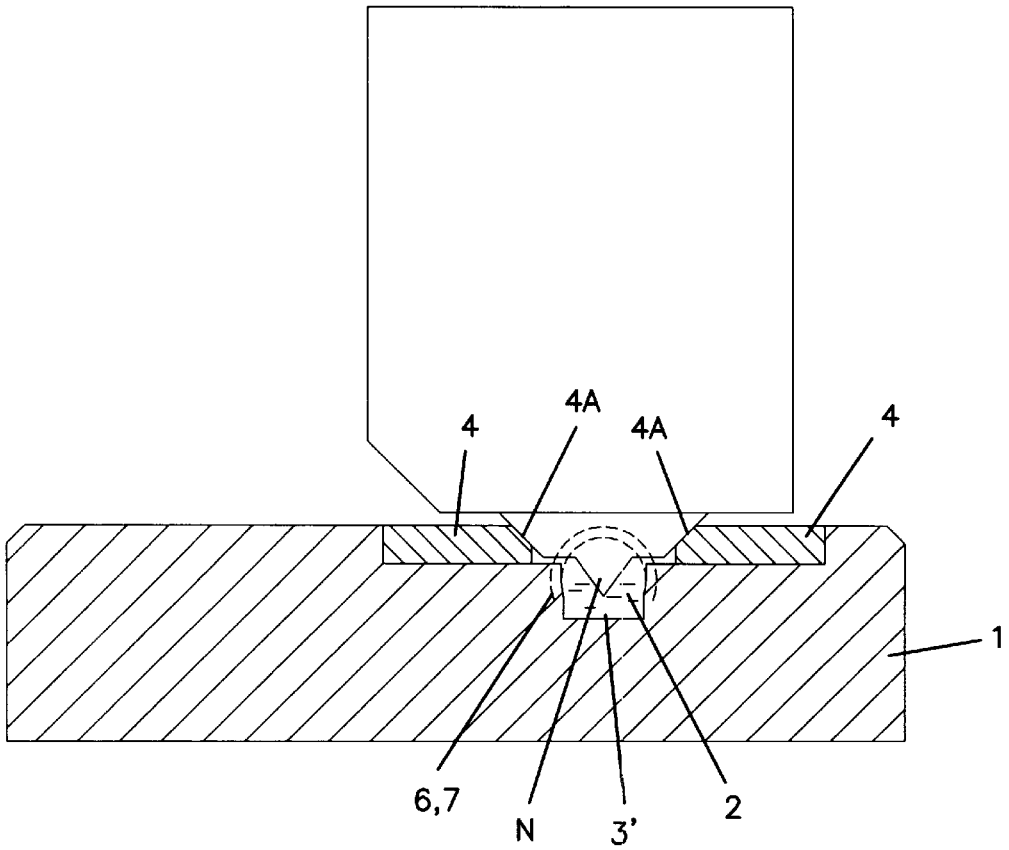
FIG. 4 is also a cross-sectional view showing another embodiment in the same manner as FIG. 2.

Hereinafter, detailed explanation of the embodiments according to the present invention will be given with reference to the attached drawings. Here, FIG. 1 is a plan view of showing a cleaning device in accordance with the present invention; FIG. 2 is an enlarged cross-sectional view along a cutting line A—A in FIG. 1; FIG. 3 is a cross-sectional view showing a pre-dispenser stage; and FIG. 4 is also a cross-sectional view showing another embodiment in the same manner of FIG. 2.

A cleaning device 1 is constructed with a cleaning portion 2 and a reservoir portion 3 which are provided side by side. The cleaning portion 2 is longer than the breadth of the nozzle N (FIG. 2) and has an upper surface opened, and it is provided with receiver plates 4, 4 for the nozzle, being attached at both sides thereof with screws 5. The receiver plates 4, 4 are adapted to be exchangeable so as to have their thickness in conformity with the length of the protrusion at a tip of the nozzle N, thereby maintaining the distance between the tip of the nozzle N and the bottom of the cleaning portion 2 at a constant value. Further, the receiver plate 4 is provided with a tapered face 4*a* on which the side surface of the nozzle N comes in contact, and therefore a substantially air-tight space or volume is defined when the nozzle N is mounted on the receiver plates 4, 4.

Moreover, a gas supply conduit 6 is coupled at one end of the cleaning portion 2 in the breadth direction of the nozzle, and a cleaning liquid supply conduit 9 is coupled in the vicinity of the gas supply conduit 6, preferably in communication therewith. Further, at the other end of the cleaning portion 2, there is connected an exhaust conduit 7 which is coupled to a vacuum pump, etc.

Furthermore, on the cleaning liquid reservoir 3, there are also attached receiver plates 8, 8 in a exchangeable manner, for the same purpose as the receiver plates 4, 4.

In the above description, for cleaning the nozzle, air is discharged from the air-tight space which is defined by the cleaning portion 2 and the nozzle N through the exhaust conduit 7 and gas is supplied into the air-tight space, under the condition that the nozzle N is mounted on the receiver plates 4, 4. Then, since the air inside of the air-tight space is extracted from the exhaust conduit 7, a gas supplied from the one end flows towards the exhaust conduit 7 at the other end. At this time, the cleaning liquid is supplied from the cleaning liquid supply conduit 9. Further, the cleaning liquid contacts with the surface of the nozzle so as to dissolve and wash away all the liquid paint adhering thereon. Alternatively, the cleaning can also be achieved by stopping the supply of gas and supplying only the cleaning liquid, in the same manner. After this, by closing the cleaning liquid supply conduit 9 so as to supply only the gas, the cleaning liquid, which remains adhering at the nozzle tip of the nozzle after the cleaning, can be evaporated, thereby enabling drying of the tip of the nozzle.

Further, in the case where the nozzle is used after completing the cleaning thereof, as shown in FIG. 3, the nozzle N is set on the pre-dispense stage 10 so as to vacuum the excess liquid paint through a vacuum opening from the nozzle N, and thereafter it is used to apply fresh paint. By doing so, the liquid paint can be prevented from dripping.

FIG. 4 is a cross-sectional view showing another embodiment in the same manner of FIG. 2, and in this embodiment, a reservoir portion 3' for storing the cleaning liquid therein is formed at the bottom of the cleaning portion 2. Therefore, it is so adapted that the nozzle, the cleaning of which has been completed, can stand therein for a long time period.

As is fully explained above, in accordance with the present invention, there is provided a cleaning device for cleaning an applicator nozzle having a discharge opening of a predetermined breadth for liquid paint, comprising: a cleaning portion being longer than the breadth of said nozzle and having an upper surface opened, wherein said cleaning portion defines a substantially air-tight space therein when said nozzle is mounted thereon; a gas supply conduit being opened at one end of said cleaning portion, in a direction of breadth of said nozzle; a cleaning liquid supply conduit being disposed in a vicinity of said gas supply conduit; and an exhaust gas conduit being opened at the other end of said cleaning portion, wherein since the cleaning liquid contacts and washes away the liquid paint adhering upon the nozzle surface while being supplied from the one end and discharged from the other end, it is possible to effect cleaning or washing thereof with good efficiency.

In particular, in the case where the supply slit for the cleaning liquid is formed at the side surface of the cleaning portion opposite to the nozzle, and when the cleaning liquid which is supplied through the slit is discharged down to the lower side of the cleaning portion, no cleaning liquid will be wasted, thereby being advantageous in cost.

What is claimed is:

1. A cleaning device for cleaning an applicator nozzle having an opening of a predetermined breadth for discharging liquid paint, comprising:

a cleaning portion being longer than the breadth of said nozzle and having an upper surface opened, wherein said cleaning portion defines a substantially air-tight space therein when said nozzle is mounted thereon;

a gas supply conduit being opened at one end of said cleaning portion, in a direction of the breadth of said nozzle;

a cleaning liquid supply conduit being disposed in a vicinity of said gas supply conduit; and an exhaust gas conduit being opened at the other end of said cleaning portion, wherein gas from said gas supply conduit flows from the one end of said cleaning portion across the breadth of said nozzle for exhaust from said exhaust gas conduit at the other end of said cleaning portion, said gas flowing in the substantially air-tight space.

2. A cleaning device for cleaning an applicator nozzle as defined in claim 1, wherein a cleaning liquid reservoir portion is provided in addition to said cleaning portion, for the purpose of dipping a tip of said applicator nozzle in the cleaning liquid for a long time.

3. A cleaning device for cleaning an applicator nozzle as defined in claim 1, wherein a cleaning liquid reservoir portion is formed at a bottom of said cleaning portion for storing the cleaning liquid therein, thereby allowing said nozzle, the cleaning of which has been completed, to stand therein for a long time.

4. A cleaning method for using a cleaning device for cleaning an applicator nozzle having an opening of a predetermined breadth for discharging liquid paint, said cleaning device including a cleaning portion which is longer than the breadth of said nozzle and has an upper surface opened, said cleaning portion defining a substantially air-tight space therein when said nozzle is mounted thereon, said cleaning device also including a gas supply conduit which is opened at one end of said cleaning portion in a direction of the breadth of said nozzle, a cleaning liquid supply conduit which is disposed in a vicinity of said gas supply conduit, and an exhaust gas conduit which is opened at the other end of said cleaning portion, said method comprising the steps of:

cleaning said nozzle with a cleaning liquid, and thereafter, drying said nozzle with gas, said gas being from said gas supply conduit and flowing from the one end of said cleaning portion across the breadth of said nozzle for exhaust from said exhaust gas conduit at the other end of said cleaning portion, said gas flowing in the substantially air-tight space.

5. A cleaning method for using a cleaning device for cleaning an applicator nozzle having an opening of a predetermined breadth for discharging liquid paint, said cleaning device including a cleaning portion which is longer than the breadth of said nozzle and has an upper surface opened, said cleaning portion defining a substantially air-tight space therein when said nozzle is mounted thereon, said cleaning device also including a gas supply conduit which is opened at one end of said cleaning portion in a direction of the breadth of said nozzle, a cleaning liquid supply conduit which is disposed in a vicinity of said gas supply conduit, and an exhaust conduit which is opened at the other end of said cleaning portion, said method comprising the steps of:

closing said gas supply conduit, supplying cleaning liquid from said cleaning liquid supply conduit so that said cleaning liquid flows in the substantially air-tight space from the one end of said cleaning portion across the breadth of said nozzle for exhaust from said exhaust conduit at the other end of said cleaning portion.

* * * * *